US007773931B2

(12) United States Patent
Jung et al.

(10) Patent No.: US 7,773,931 B2
(45) Date of Patent: Aug. 10, 2010

(54) FUSING DEVICE AND IMAGE FORMING APPARATUS HAVING THE SAME

(75) Inventors: Chang-hoon Jung, Seoul (KR); Dong-woo Lee, Seoul (KR); Tae-gyu Kim, Hwaseong-si (KR); Su-ho Shin, Seongnam-si (KR); Dong-jin Seol, Suwon-si (KR); Hwan-hee Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 189 days.

(21) Appl. No.: 12/104,699

(22) Filed: Apr. 17, 2008

(65) Prior Publication Data

US 2009/0110451 A1 Apr. 30, 2009

(30) Foreign Application Priority Data

Oct. 24, 2007 (KR) ..... 10-2007-0107223

(51) Int. Cl.
*G03G 15/20* (2006.01)

(52) U.S. Cl. ..... 399/329; 399/328

(58) Field of Classification Search ..... 399/329, 399/320, 328; 219/216; 430/124.3
See application file for complete search history.

(56) References Cited

U.S. PATENT DOCUMENTS 5,960,243 A * 9/1999 Daigo et al. ..... 399/329
7,035,581 B2 * 4/2006 Cho et al. ..... 399/329
7,623,817 B2 * 11/2009 Jung et al. ..... 399/328
2003/0228179 A1 * 12/2003 Yaomin et al. ..... 399/329
2009/0092423 A1 * 4/2009 Shin et al. ..... 399/329

FOREIGN PATENT DOCUMENTS

| | | |
|---|---|---|
| EP | 1973011 | 9/2008 |
| EP | 2006749 | 12/2008 |
| JP | 2006215056 | 8/2006 |

OTHER PUBLICATIONS

European Search Report issued Feb. 4, 2009 in EP Application No. 08165025.1.

* cited by examiner

*Primary Examiner*—David M Gray
*Assistant Examiner*—Rodney Bonnette
(74) *Attorney, Agent, or Firm*—Stanzione & Kim, LLP

(57) ABSTRACT

A fusing device includes a pressure unit, a belt unit to rotate in outer contact with the pressure unit, a nip forming unit to form a nip over a contact portion between the pressure unit and the belt unit, a heating unit to heat the nip forming unit and the belt unit, and a support unit to press and support the nip forming unit constantly and having a plurality of heat transmission portions defined in a parallelogrammic shape of an oblique direction with respect to a traveling direction of the belt unit.

20 Claims, 11 Drawing Sheets

FUSING DEVICE AND IMAGE FORMING APPARATUS HAVING THE SAME

CROSS-REFERENCE TO RELATED APPLICATIONS

This application claims priority under 35 U.S.C. §119 (a) from Korean Patent Application No. 10-2007-107223, filed on Oct. 24, 2007, in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to an improved belt type fusing device to fuse a developer image onto a recording medium and an image forming apparatus having the same.

2. Description of the Related Art

In general, an image forming apparatus using an electrophotographic process, such as a printer, a photocopier, and a multifunction peripheral, has a fusing device to semi-permanently fuse a developer image transferred to a recording medium by a transfer device onto the recording medium by heating and pressing the developer image. Such a fusing device includes a roller type fusing device and a belt type fusing device.

The main technical requirements for the fusing device are heating performance and fusing performance. In order to achieve high speed heating performance, a heater should decrease a heat capacity. Main factors affecting toner fusing performance are temperature, pressure, and nip width. If the fusing temperature is higher within a range from a cold offset to a hot offset, the fusing performance can be better, and also if the pressure is higher and the nip width is larger, a better fusing performance can be achieved.

FIG. 1 is a view illustrating a conventional roller type fusing device. As illustrated in FIG. 1, the conventional roller type fusing device includes a pressure roller 10 and a heating roller 20 which are rotated in close contact with each other, and a heating member 30 disposed in the heating roller 20. In this fusing device, the heating member 30 has a high heat capacity, and since the fusing device is designed to heat the entire heating roller 20, a long time is required to heat the heating roller 20. Also, since a nip N is formed on a contact surface between the pressure roller 10 and the heating roller 20, the width of the nip P is narrow.

FIG. 2 is a view illustrating a conventional belt type fusing device suggested for the purpose of enhancing a heating temperature. The fusing device of FIG. 2 includes a pressure roller 10, a fusing belt 40 rotating with a rotational force received from the pressure roller 10, a guide member 50 disposed in the fusing belt 40 to guide a rotational movement of the fusing belt 40, and a heating member 60 disposed on the guide member 50 to heat a nip N of the fusing belt 40.

The belt type fusing device described above has a low heat capacity of the heating member 60 and employs a localized heating method of heating only the nip N. Compared to the roller type fusing device of FIG. 1, the belt type fusing device can shorten a time required to heat and broaden the width of the nip N. However, since the heating member 60 is disposed on the nip N and thus is subjected to a pressure from the pressure roller 10, the pressure of the pressure roller 10 is limited below an endurance strength of the heating member 60. Therefore, the pressure at the nip N is lower than expected and thus good fusing performance cannot be achieved due to an insufficient level of pressure. Also, if the pressure at the nip N is increased in order to enhance the fusing performance, the heating member 60 may be damaged due to pressure and thermal deformation.

SUMMARY OF THE INVENTION

The present general inventive concept provides a fusing device which guarantees high speed heating performance and a stable nip in a breadthwise direction of a recording medium, and also is capable of uniformly heating a belt unit in a breadthwise direction of a recording medium.

The present general inventive concept also provides an image forming apparatus which has the fusing device described above and thus guarantees high speed heating performance and a thermal stability and thus enables a high speed printing operation.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a fusing device including a pressure unit, a belt unit to rotate in outer contact with the pressure unit, a nip forming unit to form a nip over a contact portion between the pressure unit and the belt unit, a heating unit to heat the nip forming unit and the belt unit, and a support unit to press and support the nip forming unit constantly and having a plurality of heat transmission portions defined in a parallelogrammic shape of an oblique direction with respect to a traveling direction of the belt unit.

The pressure unit may include a rotary roller member, and the belt unit may include a belt member rotated by a rotational force received from the roller member.

The support unit may include opposite support members corresponding to opposite ends of the nip forming unit, and a reinforcing member to connect the opposite support members. The reinforcing members may include a plurality of oblique line type reinforcing ribs arranged at regular intervals along a lengthwise direction of the reinforcing member in order to define the plurality of heat transmission portions. The reinforcing member may be in an arch shape, and the opposite support members and the reinforcing member may be integrally formed with each other.

The support unit may satisfy the following equation:

$$\tan\theta=(w+t)/h$$

wherein 'w' denotes a width of the heat transmission portion, 'h' denotes a height of the heat transmission portion, 't' denotes a thickness of the reinforcing rib, and 'θ' denotes an angle formed by the reinforcing rib with respect to a traveling direction of the belt unit.

The heat transmission portions of the support unit may be arranged along two or more lines.

The nip forming unit may include a body portion to collect radiant heat from the heating unit, and a nip portion connected with the body portion and contacting the belt unit. A portion of the body portion corresponding to the heat transmission portions of the support unit may be opened. Alternatively, the body portion may include an arch type reinforcing portion to reinforce a strength of the nip forming unit. The reinforcing portion may include a plurality of second heat transmission portions corresponding to the heat transmission portions of the support unit. The second heat transmission portions may be arranged along two or more lines.

The fusing device may further include a heat insulating member disposed between the nip portion of the nip forming unit and the opposite support members of the support unit to prevent heat of the nip forming unit from being transmitted to the support unit. The heat insulating member may have a curved surface contacting the belt unit.

The foregoing and/or other aspects and utilities of the general inventive concept may also be achieved by providing a fusing device, including a rotatable pressure roller, a fusing belt to rotate with a rotational force received from the pressure roller, a nip forming member having a nip portion which is inner contact with the fusing belt to form a nip over a contact portion between the pressure roller and the fusing belt, a heating member disposed substantially at a center of the fusing belt to heat the nip forming member and the fusing belt, opposite support members disposed inside the fusing belt to press and support opposite sides of the nip portion of the nip forming member toward the pressure roller, and a reinforcing member in an arch shape to connect the opposite support members to reinforce a strength of the opposite support members and having a plurality of heat transmission portions defined in a parallelogrammic shape of an oblique direction with respect to a forward direction of the belt unit in order to uniformly transmit radiant heat from the heating member to the fusing belt.

The foregoing and/or other aspects and utilities of the general inventive concept may also be achieved by providing an image forming apparatus including a photoconductive medium where an electrostatic latent image is formed, a developing device to develop the electrostatic latent image of the photoconductive medium with a developer, a transfer device to transfer a developer image from the photoconductive medium to a recording medium; and a fusing device to fuse the developer image onto the recording medium, the fusing device including a pressure unit, a belt unit to rotate in outer contact with the pressure unit, a nip forming unit to form a nip over a contact portion between the pressure unit and the belt unit, a heating unit to heat the nip forming unit and the belt unit, and a support unit to press and support the nip forming unit constantly and having a plurality of heat transmission portions defined in a parallelogrammic shape of an oblique direction with respect to a traveling direction of the belt unit.

The foregoing and/or other aspects and utilities of the general inventive concept may also be achieved by providing a fusing device usable with an image forming apparatus, the fusing device including a pressure unit, a nip forming unit to form a nip on a portion of the pressure unit, and a support unit to uniformly support the nip along an axial direction and to simultaneously press the nip against the pressure unit.

The foregoing and/or other aspects and utilities of the general inventive concept may also be achieved by providing a fusing device usable with an image forming apparatus, the fusing device including a pressure unit, a belt unit to contact the pressure unit, a nip forming unit to form a nip on a portion of the pressure unit, and a support unit including a reinforcing member having a plurality of heat transmission portions, the plurality of heat transmission to allow radiant heat to be uniformly distributed to the belt unit, wherein the reinforcing member to constantly press the nip forming unit.

The plurality of heat transmission portions may have a parallelogrammic shape.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
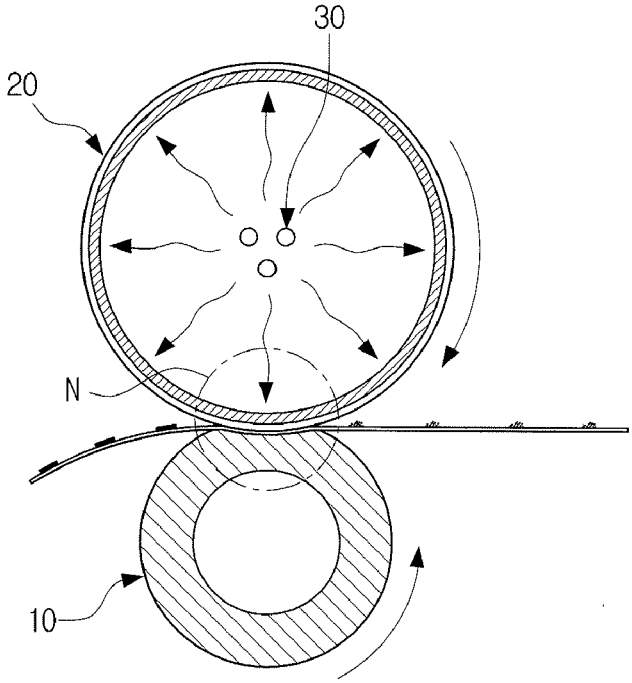
FIG. 1 (PRIOR ART)
FIG. 1 is a cross-section view illustrating a conventional roller type fusing device.
Figure 2:
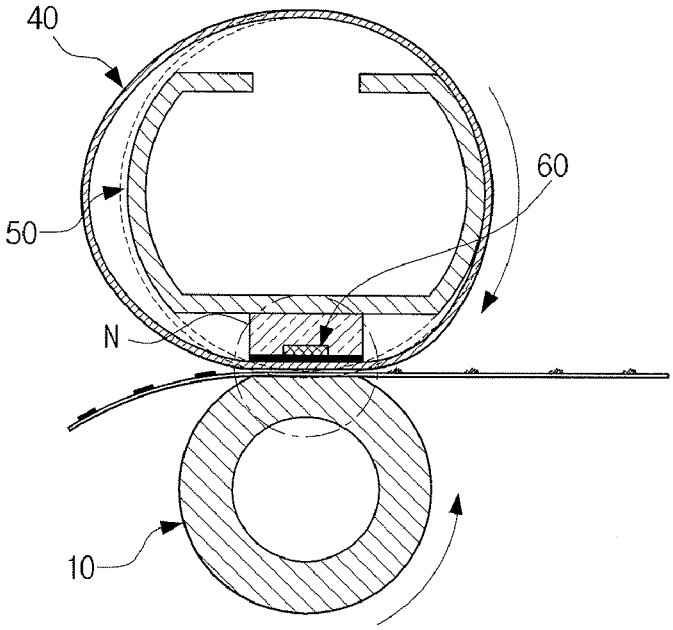
FIG. 2 (PRIOR ART)
FIG. 2 is a cross-section view illustrating a conventional belt type fusing device.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
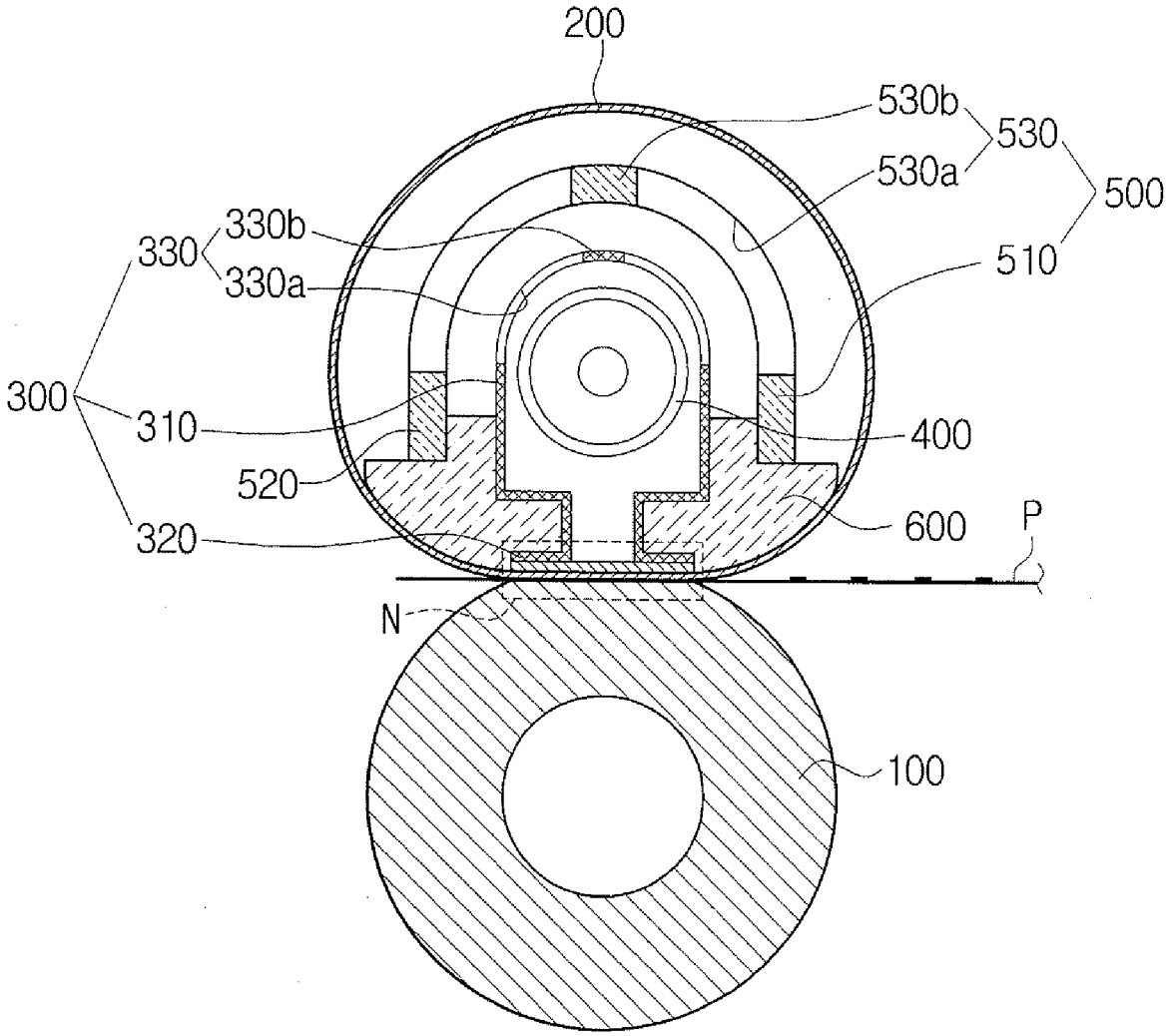
FIG. 3 is a schematic cross-section view illustrating a fusing device according to an exemplary embodiment of the present general inventive concept.
Figure 4:
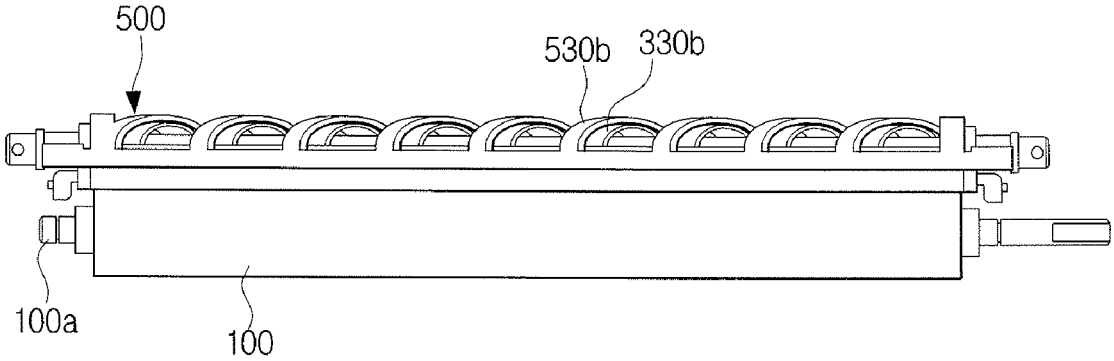
FIG. 4 is a front perspective view illustrating the fusing device of FIG. 3 from which a belt unit is removed.
Figure 5:
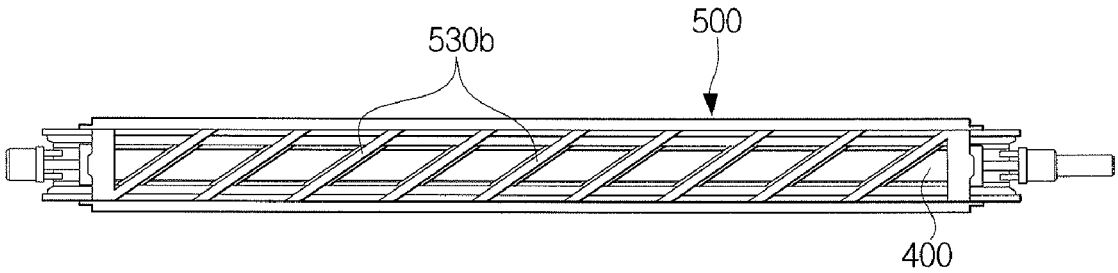
FIG. 5 is a plan view of FIG. 4.

As illustrated in FIGS. 3 to 5, a fusing device according to an exemplary embodiment of the present general inventive concept includes a pressure unit 100, a belt unit 200 rotating in outer contact with the pressure unit 100, a nip forming unit 300 disposed in inner contact with the belt unit 200 to form a nip N over a contact portion between the pressure unit 100 and the belt unit 200, a heating unit 400 disposed in the belt unit 200 to heat the nip forming unit 300 and the belt unit 200, and a support unit 500 to press and support the nip forming unit 300 toward the pressure unit 100 in order for the nip forming unit 300 to form a constant nip N in a breadthwise direction of a recording medium P.

The pressure unit 100 is a long cylindrical roller member that forms a nip N in association with the belt unit 200 and brings the recording medium P into a pressure contact with the belt unit 200. In the drawings, a roller member is illustrated as the pressure unit 100, but it is merely an example and beside this roller type pressure unit 100, a belt type pressure unit or a pad type pressure unit may be used. However, in consideration of a potential slip occurring during the transfer of the recording medium P, the rotary roller type pressure unit 100 of the present embodiment is suitable since the rotary roller type pressure unit 100 would not likely cause a slip during the transfer of the recording medium P. Also, an elastic member is disposed between a rotary shaft 100*a* of the pressure unit 100 and a fusing device frame (not illustrated) to elastically support the pressure unit 100 toward the belt unit 200, but the elastic member is omitted from the drawings for the sake of clarity.

The belt unit 200 includes a belt member (also referred to as a fusing belt) which is rotated by a rotational force transmitted from the pressure unit 100. The belt unit 200 has a width corresponding to a length of the pressure unit 100 and is made of a thermostable material. More specifically, for a mono image forming apparatus, the belt unit 200 may have a single layer structure formed of a metal or a thermostable polymer. The metal may be SUS or nickel and the thermostable polymer may be polyimide. Alternatively, the belt unit 200 may have a multilayer structure. For example, the belt unit 200 may be formed of a multilayer which includes an anti-wear layer formed by coating a Teflon resin on an inner circumference of the belt unit 200 and a resilient layer such as silicon or rubber formed on an outer circumference of the belt unit 200 to respond to a color printing operation. Also, a lubricant may be coated over an inner surface of the belt unit 200 to make the belt unit 200 move smoothly.

Also, the belt unit 200 has a constant tension to rotate smoothly, and a constant pressure required to fuse a developer image onto the recording medium P exists between the pressure unit 100 and the belt unit 200. The pressure is uniformly exerted over an entire surface of the belt unit 200 in a breadthwise direction due to the support unit 500, which will be described below. In this embodiment, the belt unit 200 is driven by the driving of the pressure unit 100, but an extra driving device may be provided to drive the belt unit 200. Also, the pressure unit 100 may be driven by rotating the belt unit 200.

The nip forming unit 300 includes a body portion 310 formed to collect radiant heat from the heating unit 400, and a nip portion 320 to form a nip N over a contact portion between the pressure unit 100 and the belt unit 200. Also, the body portion 310 includes an arch type reinforcing portion 330 to reinforce strength of the nip forming unit 300. The strength of the nip forming unit 300 is reinforced by the reinforcing portion 330 so that a constant nip N can be formed in a breadthwise direction of the recording medium P.

Figure 6A:
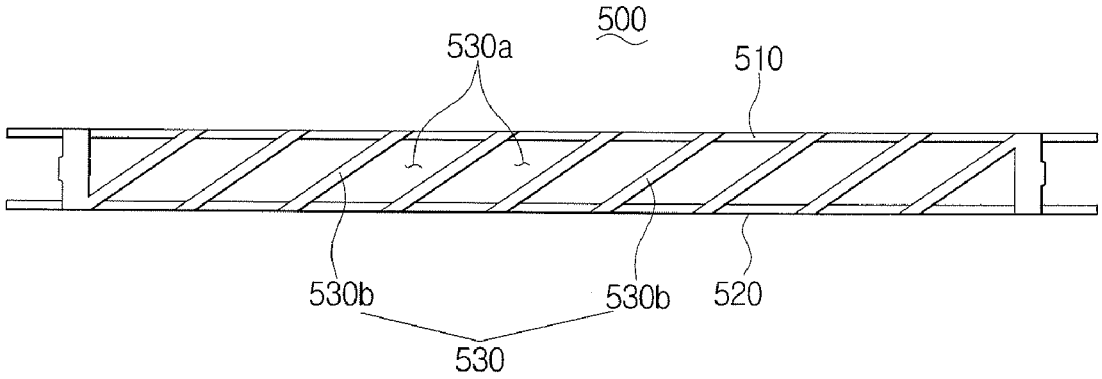
FIGS. 6A and 6B are views illustrating a support unit and a nip forming unit applied to the fusing device of FIG. 3.
Figure 6B:
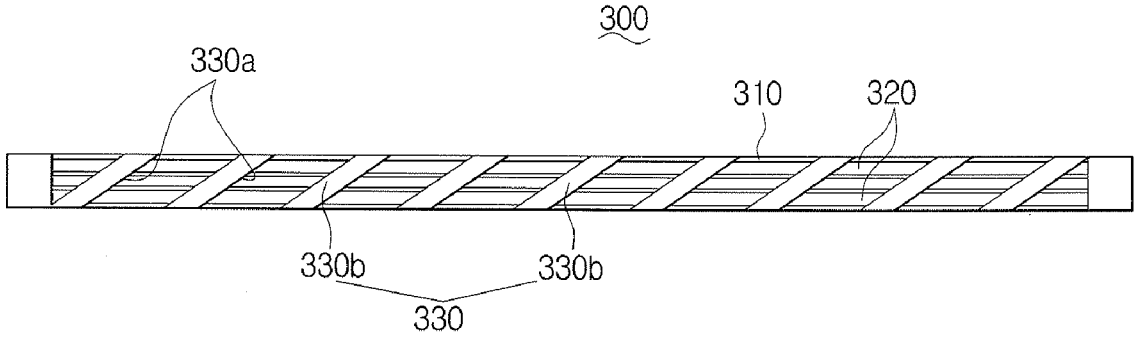

Referring to FIG. 6B, the reinforcing portion 330 has a plurality of second heat transmission portions 330*a* to directly transmit radiant heat from the heating unit 400 disposed inside the reinforcing portion 330 to the belt unit 200. The plurality of second heat transmission portions 330*a* are defined in a parallelogrammic shape to allow the heating unit 400 to uniformly heat the belt unit 200 in a breadthwise direction. In order to define the parallelogrammic-shaped second heat transmission portions 330*a*, the reinforcing portion 330 has a plurality of reinforcing ribs 330*b* arranged in an oblique direction with respect to a traveling direction of the belt unit 200. These second heat transmission portions 330*a* has a same structure and a same effect as the first heat transmission portions of the support unit 500, which will be described in detail below, and thus their detailed descriptions are omitted.

The body portion 310 is designed to collect radiant heat from the heating unit 400 and transmit the collected thermal energy to the nip portion 320. Also, at least one slit is formed on the body portion 310 to directly transmit the radiant heat from the heating unit 400 to the nip portion 320. The nip forming unit 300 is formed of a metal material having good thermal conductivity such as aluminum or copper or an alloy thereof.

In this embodiment of FIG. 3, the nip portion 320 and the body portion 310 are separately formed and then are assembled with each other to form the nip forming unit 300 for the convenience of manufacture by way of an example. However, in order to reduce a contact thermal resistance between the members, the body portion 310 and the nip portion 320 are integrally formed with each other. Also, albeit not illustrated in the drawings, a surface of the nip portion 320 facing the pressure unit 100 may be curved corresponding to an outer circumference of the pressure unit 100 for the purpose of increasing an adherence to the recording medium P and thus improving fusing performance.

The heating unit 400 is disposed substantially at a center of the belt unit 200. That is, the heating unit 400 is located such that the heating unit 400 directly transmits radiant heat to at least a portion of an inner surface of the belt unit 200 and at least a portion of a surface of the nip forming unit 300. The heating unit 400 is supplied with power externally and generates heat, thereby heating the nip forming unit 300 and the belt unit 200 simultaneously. As the heating unit 400, a lamp heater, a heating coil, or a plane heater having a resistance pattern may be used, and also, a cylindrical halogen lamp may be used. Also, the fusing device may include a temperature sensor to detect a temperature of the heating unit 400 or the belt unit 200, and a temperature controller to control the temperature of the heating unit 400 or the belt unit 200 detected by the temperature sensor, but they are omitted from the drawings.

The support unit 500 is a structure that has predetermined strength sufficient to support and press the nip portion 320 of the nip forming unit 300. The support unit 500 is formed of a metallic material having good strength such as a stainless steel or spring steel. The support unit 500 supports the nip forming unit 300, in particularly, the nip portion 320 at opposite side surfaces, and simultaneously, presses the nip portion 320 against the pressure unit 100, thereby forming a uniform nip N in an axial direction.

More specifically, the support unit 500 is disposed in the fusing device frame of an image forming apparatus (not illustrated), and a concentrated load is generated at opposite ends of the support unit 500 by a spring (not illustrated) disposed between the support unit 500 and the fusing device frame. However, since the support unit 500 has a predetermined strength, the pressure is uniformly applied to the nip forming unit 300 along the axial direction so that a uniform nip width and a constant pressure can be maintained and thus a good fusing performance can be achieved.

If the strength of the support unit 500 is low, the support unit 500 is likely to be bent and thus cannot uniformly press the nip forming unit 300. That is, the support unit 500 requires a bending strength to prevent a bending deflection caused by a force exerted to the opposite ends of the support unit 500, and for this, a moment of inertia of cross sectional area should increase.

In consideration of the above, the support unit 500 according to the exemplary embodiment of the present general inventive concept, as illustrated in FIG. 6A, includes opposite support members 510 and 520 corresponding to opposite sides of the nip portion 320 of the nip forming unit 300, and a reinforcing member 530 to connect the opposite support members 510 and 520 to reinforce the strength of the support unit 500.

The reinforcing member 530 may have an arch shape and the strength of the support unit 500 increases due to the reinforcing member 530 so that a bending does not occur. Accordingly, if the support unit 500 presses the nip forming unit 300, a constant force is exerted to the nip forming unit 300 in a lengthwise direction and thus a constant and uniform nip N can be formed between the belt unit 200 and the pressure unit 100 in a breadthwise direction of the recording medium P.

The reinforcing member 530 of the support unit 500 increases the strength of the support unit 500, but, since the reinforcing member 530 is disposed between the heating unit 400 and the belt unit 200, the reinforcing member 530 hinders radiant heat of the heating unit 400 from being transmitted to the belt unit 200. In order to solve this problem, according to the exemplary embodiment of the present general inventive concept, a plurality of heat transmission portions 530*a* are defined in the reinforcing member 530 to allow the radiant heat to be uniformly transmitted from the heating unit 400 to the belt unit 200.

In this embodiment, the plurality of heat transmission portions 530*a* are defined in a parallelogrammic shape of an oblique direction with respect to a travelling direction of the belt unit 200, and for this, the reinforcing member 530 has a plurality of oblique line type reinforcing ribs 530*b* arranged at regular intervals along a lengthwise direction of the reinforcing member 530 as illustrated in FIG. 6A.

Figure 7:
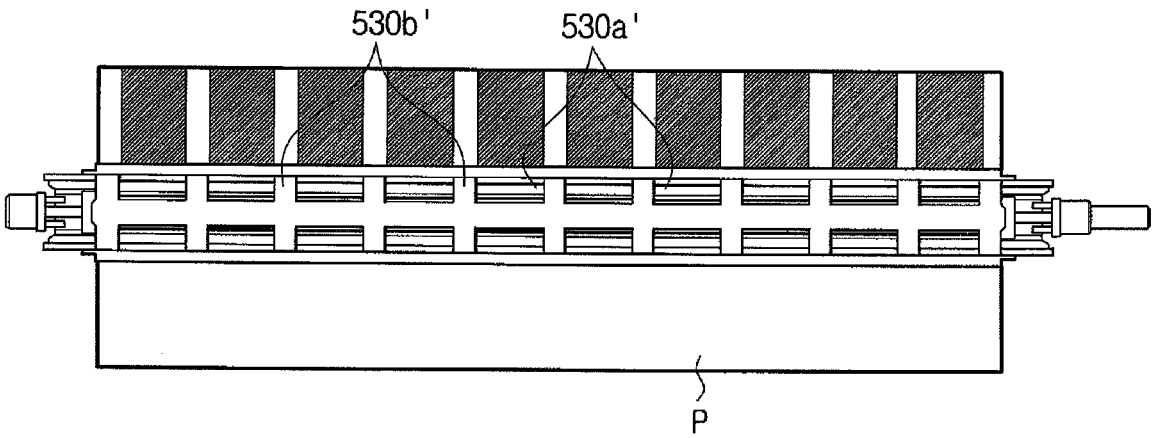
FIG. 7 is a schematic view illustrating the fusing device employing a support unit having a reinforcing member having a rectangular heat transmission portion to explain an effect of a reinforcing member having a parallelogrammic-shaped heat transmission portion according to an exemplary embodiment of the present general inventive concept.

If the heat transmission portions 530*a* of the reinforcing member 530 are defined in a rectangular shape rather than a parallelogrammic shape, as illustrated in FIG. 7, the belt unit 200 is not uniformly heated. That is, since radiant heat is not transmitted to locations where reinforcing ribs 530*b*' are formed in the same direction as the traveling direction of the belt unit 200 to define the rectangular heat transmission portions 530*a*', a temperature deviation exists in the breadthwise direction of the belt unit 200. Due to this temperature deviation of the belt unit 200, the degree of fusing of a developer image onto the recording medium P differs location by location. FIG. 7 illustrates different conditions of the developer image fused onto the recording medium P at the locations corresponding to the heat transmission portions 530*a*' and at the locations corresponding to the reinforcing ribs 530*b*' (indicated by gray color and white color, respectively, in the drawing).

If the heat transmission portions 530*a* are defined in the parallelogrammic shape as described above, the radiant heat is uniformly transmitted from the heating unit 400 over an entire portion of the belt unit 200 in the breadthwise direction. Compared to the case where no reinforcing rib 530*b* is provided, a heating temperature per one revolution of the belt unit 200 is low but at least a temperature deviation in the breadthwise direction of the belt unit 200 is not detected. Accordingly, poor fusing performance which occurs due to the temperature deviation of the belt unit 200 can be solved. That is, according to the exemplary embodiment of the present general inventive concept, the support unit 500 guarantees a stable nip due to the presence of the reinforcing member 530 and also solves poor fusing performance which may occur due to the presence of the reinforcing member 530 by employing the parallelogrammic-shaped heat transmission portions 530*a*.

Figure 8A:
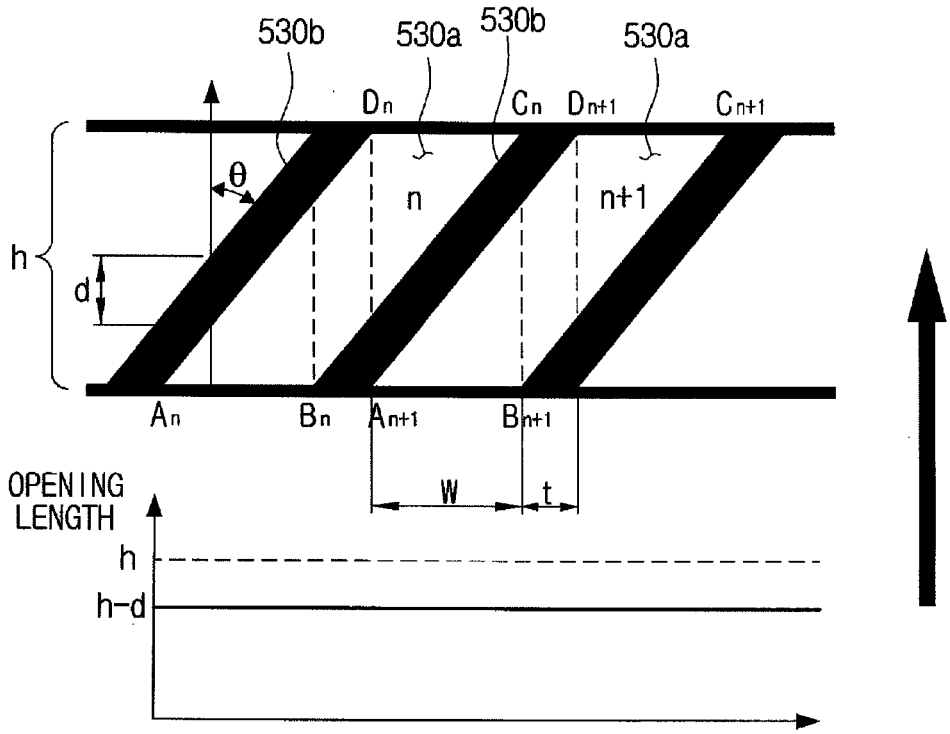
FIGS. 8A to 8F are views illustrating an optimal condition of the support unit to make the belt unit heat uniformly.

With reference to FIG. 8A, the heat transmission portions 530*a* of the reinforcing member 530 having a structure capable of uniformly heating the belt unit 200 will now be described. FIG. 8A illustrates enlargement of the reinforcing member 530 which is spread along the traveling direction of the belt unit 200.

In the drawings, 'n' and 'n+1' denote neighboring heat transmission portions 530*a* of the reinforcing element 530. The nth heat transmission portion 530*a* includes An–Bn–Cn–Dn and the n+1th heat transmission portion 530*a* includes An+1–Bn+1–Cn+1–Dn+1. The reinforcing ribs 530*b* are arranged in parallel to one another and the spread heat transmission portion 530*a* is in a parallelogrammic shape. The heat transmission portion 530*a* has a width 'w' and a height 'h'. The reinforcing rib 530*b* has a thickness 't'. The reinforcing rib 530 blocks the radiant heat from the heat unit 400 in the traveling direction of the belt unit 200 as much as length 'd'. The thickness 't' and the length d' has the following relationship if the reinforcing rib 530*b* has an angle θ with respect to the traveling direction of the belt unit 200:

$$\tan\theta = t/d$$

If a corner 'Dn' of the nth heat transmission portion and a corner An+1 of the n+1th heat transmission portion are located along the same line in the traveling direction of the belt unit 200, time required for a point of the belt unit 200 to pass through the heat transmission portion is regular per one revolution. This condition can be expressed with symbols θ, w, t by following equation 1:

$$\tan\theta = (w+t)/h \qquad \text{Equation 1}$$

wherein the width w' of the heat transmission portion 530*a* is greater than 0. If the above condition is satisfied, the belt unit 200 receives the radiant heat as much as length '(h–d)' through the heat transmission portion 530*a*, and the length '(h–d)' is the same for every heat transmission portions 530*a*. That is, the inner surface of the belt unit 200 is exposed to the heat unit 400 when the belt unit 200 passes through as much as '(h–d)'. Since the length '(h–d)' is the same for every portion, the belt unit 20 is subjected to the same amount of radiant heat prior to entering the nip and accordingly the temperature is uniform.

The above condition should be satisfied in order to obtain a most desirable result. However, if the heat transmission portions 530*a* are defined in a parallelogrammic shape of an oblique direction with respect to the traveling direction of the belt unit 200, results are slightly different depending on 'w', 'h', and 'θ' but FIGS. 8B to 8F illustrate that an entire portion of the belt unit 200 is heated.

Figure 8B:
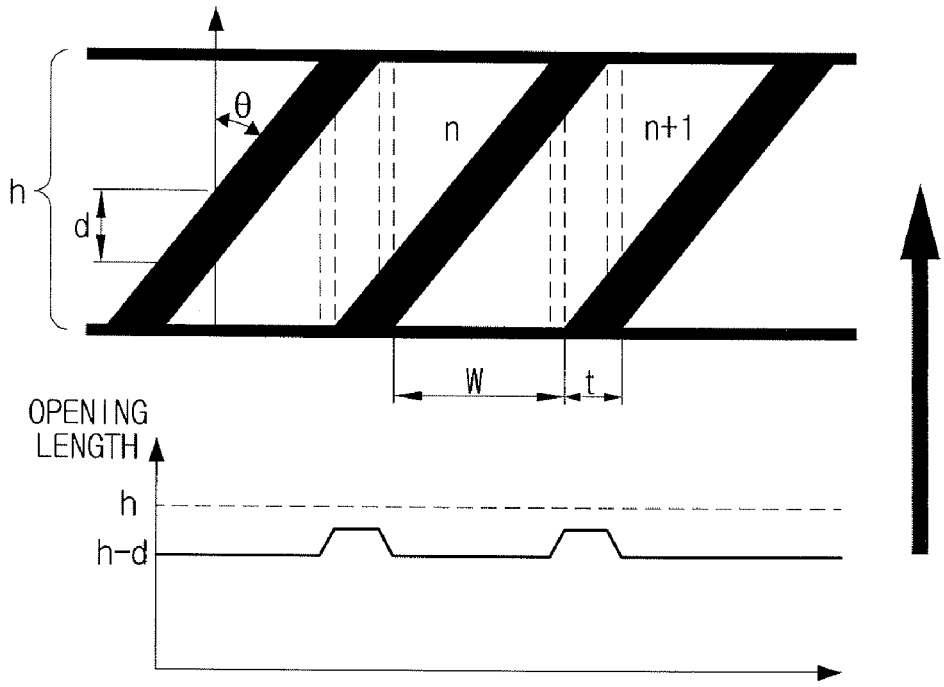
Figure 8C:
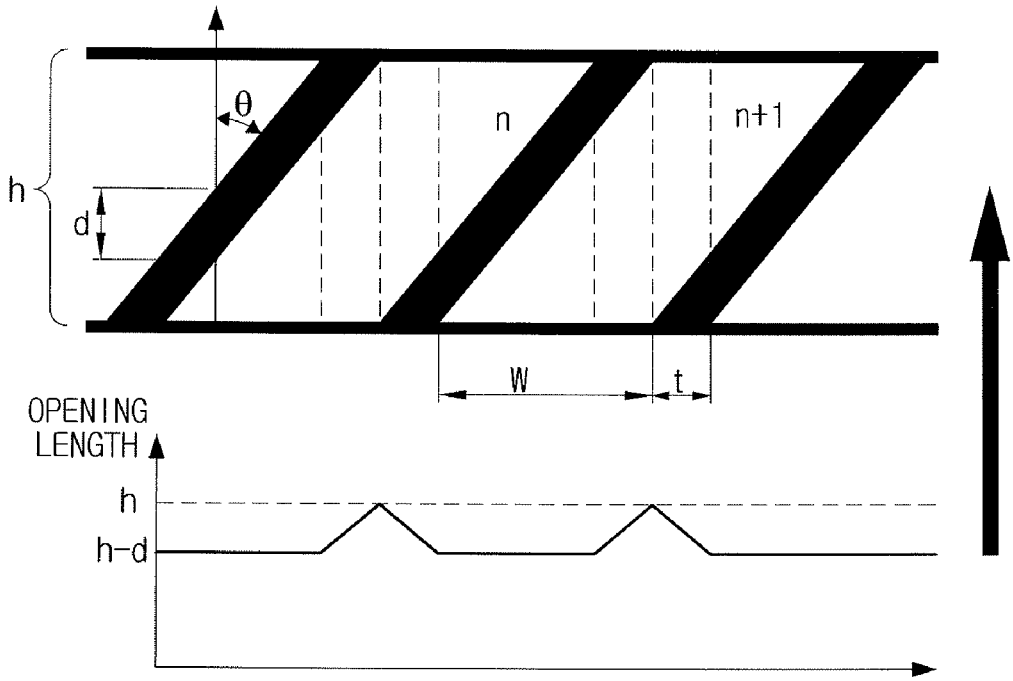
Figure 8D:
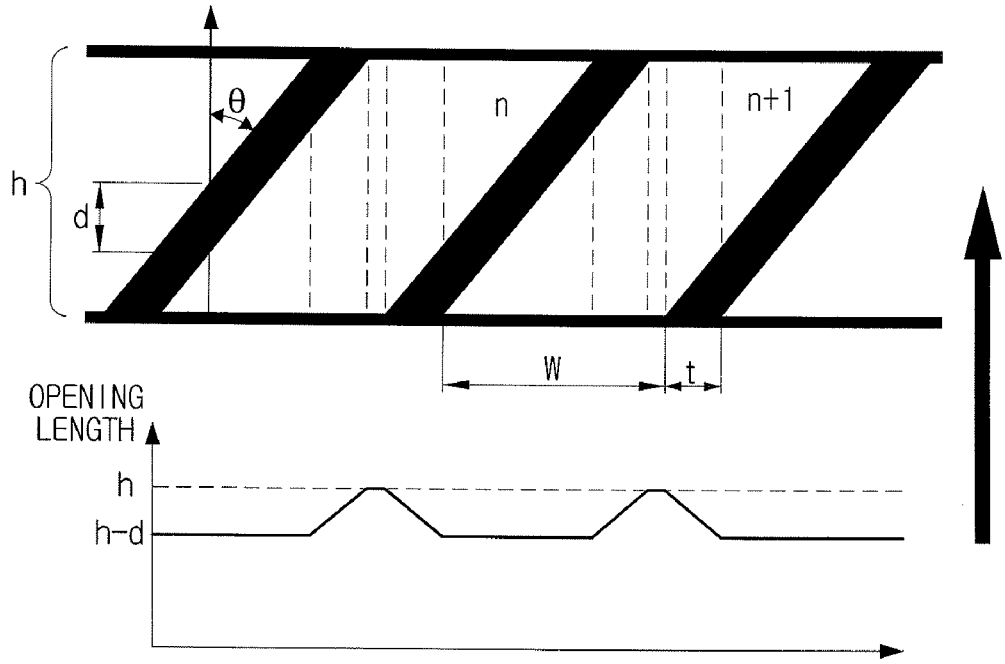
Figure 8E:
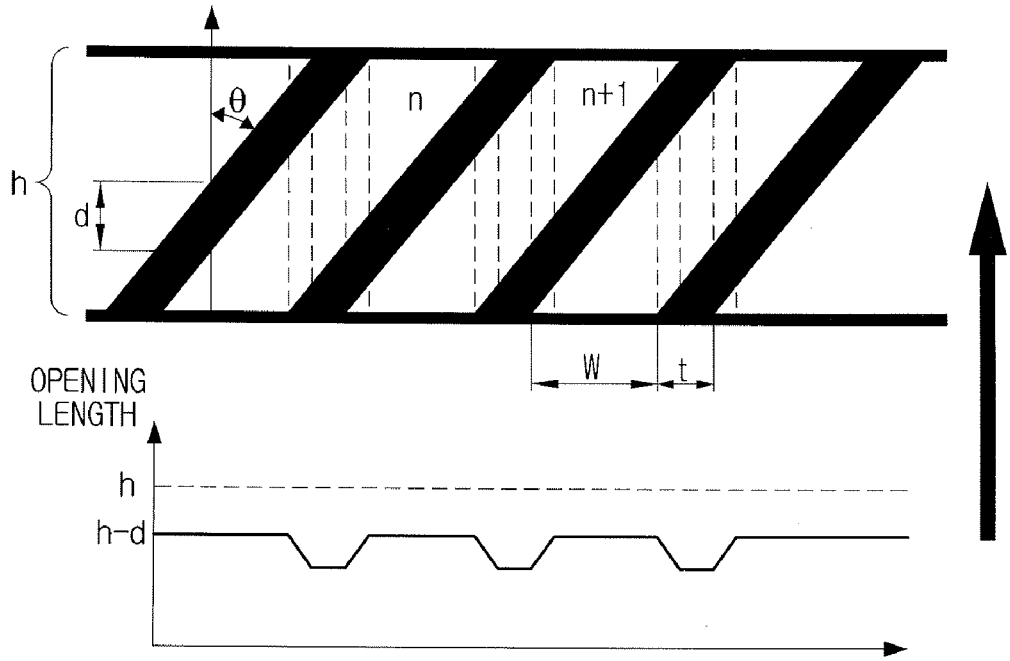
Figure 8F:
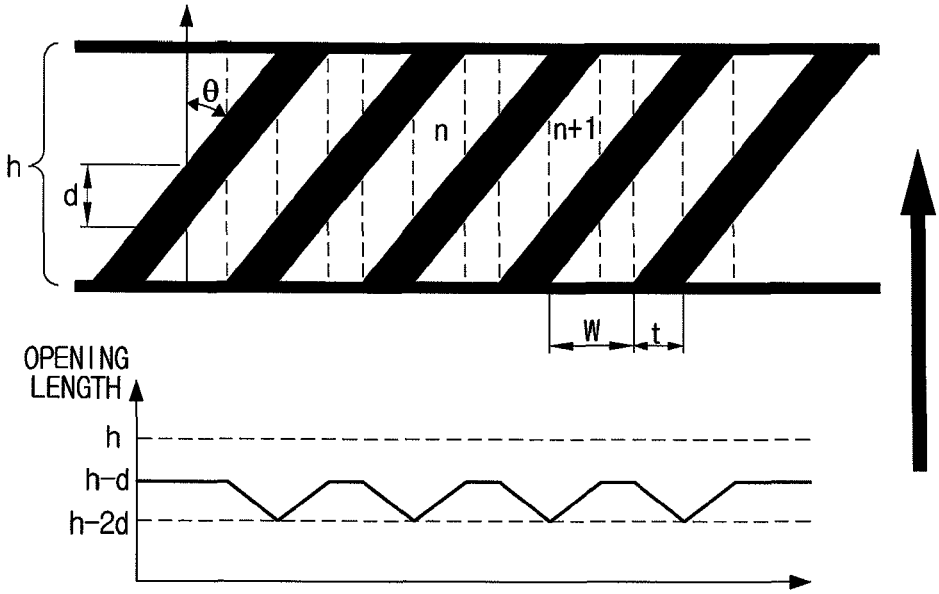

FIG. 8B illustrates variation in the length of the heat transmission portion if $w/h<\tan\theta<(w+1)/h$, FIG. 8C illustrates variation in the length of the heat transmission portion if $\tan\theta=w/h$, FIG. 8D illustration variation in the length of the heat transmission portion if $\tan\theta<w/h$, FIG. 8E illustrates variation in the length of the heat transmission portion if $(w+t)/h<\tan\theta<(w+2t)/h$, and FIG. 8F illustrates variation in the length of the heat transmission portion if $\tan\theta=(w+2t)/h$. The thick arrow in FIGS. 8A to 8F indicates the traveling direction of the belt unit 200.

As illustrated in FIGS. 8A to 8F, as the height 'h' of the heat transmission portion is higher and the length 'd' to block the radiant heat from the heat unit 200 is smaller, the deviation decreases. If 't' is smaller and 'θ' is larger, the length 'd' is smaller.

The second heat transmission portions 330*a* provided in the reinforcing element 330 of the nip forming unit 300 has the same structure as that of the heat transmission portion 530*a* of the reinforcing member 530 of the support unit 500 described above, and the second heat transmission portions 330*a* of the nip forming unit 300 correspond to the heat transmission portions 530*a* of the support unit 500 in locations thereof.

Figure 9A:
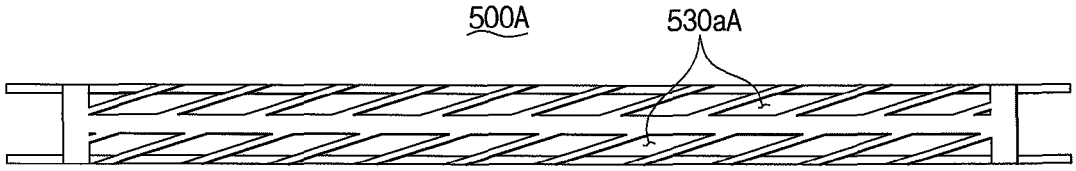
FIGS. 9A and 9B are views illustrating modified examples of the support unit and the nip forming unit.
Figure 9B:
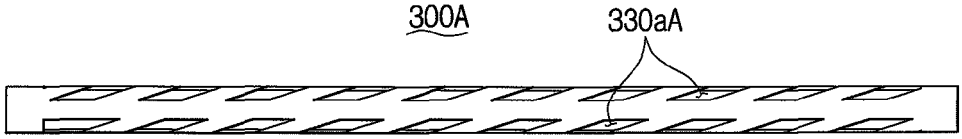

FIGS. 9A and 9B illustrate examples of a modified support unit 500A and a modified nip forming unit 300A, respectively. As illustrated in FIGS. 9A and 9B, the support unit 500A has heat transmission portions 530*a*A arranged along two lines, and the nip forming unit 300A has second heat transmission portions 330*a*A arranged along two lines. The support unit 500A and the nip forming unit 300A have the same structures as the support unit 500 and the nip forming unit 300 except for the two-line arrangements of the heat transmission portions. Therefore, detailed descriptions thereof will be omitted. Also, the heat transmission portions may be arranged in 3 lines or 4 lines.

Referring back to FIGS. 3 and 4, the fusing device according to the exemplary embodiment of the present general inventive concept includes a heat insulating member 600 disposed between the nip portion 320 of the nip forming unit 300 and the opposite support members 510 and 520 of the support unit 500 to prevent heat from being transmitted from the nip portion 320 to the support members 510 and 520. The heat insulating member 600 may be formed of a rubber of a low thermal conductivity, a heat resistant resin, a ceramic, or a polymer. Due to a presence of the heat insulating member 600, heat is prevented from being radiated from the nip portion 320 of the nip forming unit 300 to the support members 510 and 520 at an initial heating time and the heating time can be prevented from being increased.

As illustrated in FIG. 3, the heat insulating member 600 is in contact with the nip portion 320 of the nip forming unit 300 and is subjected to the pressure from the support members 510 and 520. The heat insulating member 600 has a curved surface contacting the belt unit 200 to make the belt unit 200 travel smoothly.

Figure 10:
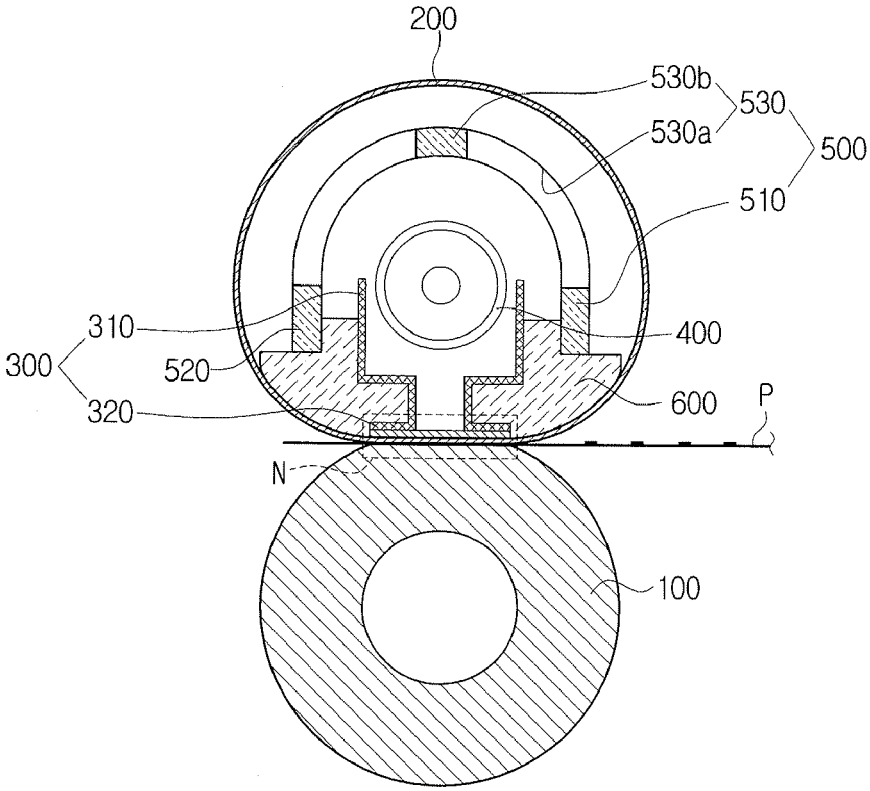
FIG. 10 is a schematic cross-section view illustrating a fusing device according to another exemplary embodiment of the present general inventive concept.
Figure 11A:
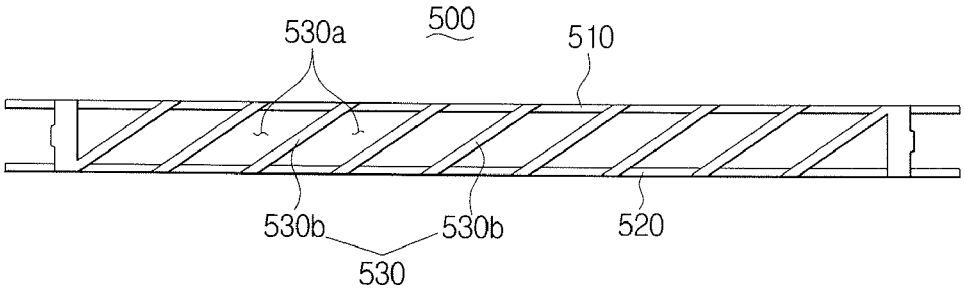
FIGS. 11A and 11B are views illustrating a support unit and a nip forming unit applied to the fusing device of FIG. 10.
Figure 11B:
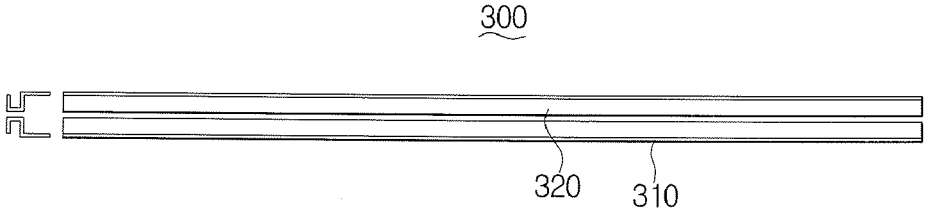

FIG. 10 is a cross-section view schematically illustrating a fusing device according to another exemplary embodiment of the present general inventive concept, and FIGS. 11A and 11B are views illustrating a support unit and a nip forming unit of the fusing device of FIG. 10.

As illustrated in FIGS. 10, 11A, and 11B, in a fusing device according to another exemplary embodiment of the present general inventive concept, a body portion 310 of a nip forming unit 300 has no reinforcing member and is opened, which differs from the above embodiment. Compared the above embodiment, the fusing device according to another exemplary embodiment of the present general inventive concept has the nip forming unit 300 being easy to manufacture. Since the structure, except for this feature, and an effect are the same as the above described embodiment, a detailed description will be omitted.

Figure 12A:
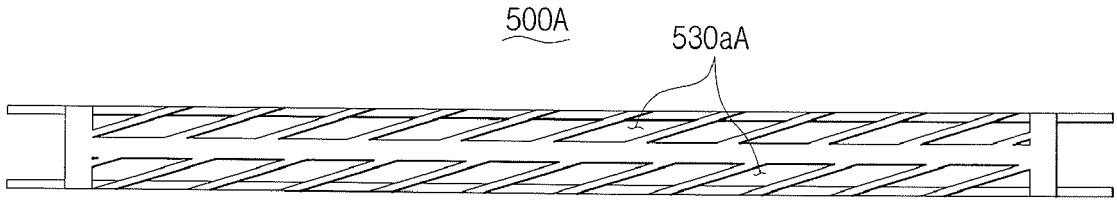
FIGS. 12A and 12B are views illustrating modified examples of the support unit and the nip forming unit.
Figure 12B:
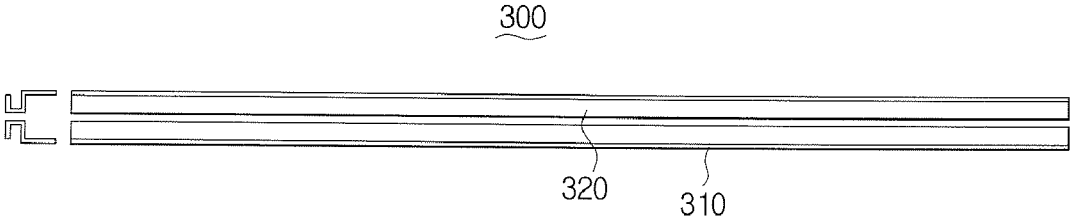

FIGS. 12A and 12B illustrate examples of a modified support unit 500A of the fusing device according to another exemplary embodiment of the present general inventive concept, and the support unit 500A has the same structure as that described in FIG. 9A. That is, a plurality of heat transmission portions 500*a*A are arranged along two lines, which differs from that of FIG. 11A. Albeit not illustrated, the heat transmission portions 500*a*A may be arranged along two or more lines.

The fusing device according to another exemplary embodiment of the present general inventive concept guarantees a constant nip in a breadthwise direction of a recording medium P due to a reinforcing member 530. The reinforcing member is disposed in a support unit 500, which is disposed in a belt unit 200 to press and support the nip forming unit 300, to reinforce strength of the support unit 500. Also, a plurality of parallelogrammic-shaped heat transmission portions 530*a* are arranged in the reinforcing member 530 such that the belt unit 200 is uniformly heated in a breadthwise direction of the recording medium. Accordingly, a developer image is fused onto the recording medium P passing through the nip between a pressure unit 100 and the belt unit 200 more efficiently through heating and pressing processes.

Figure 13:
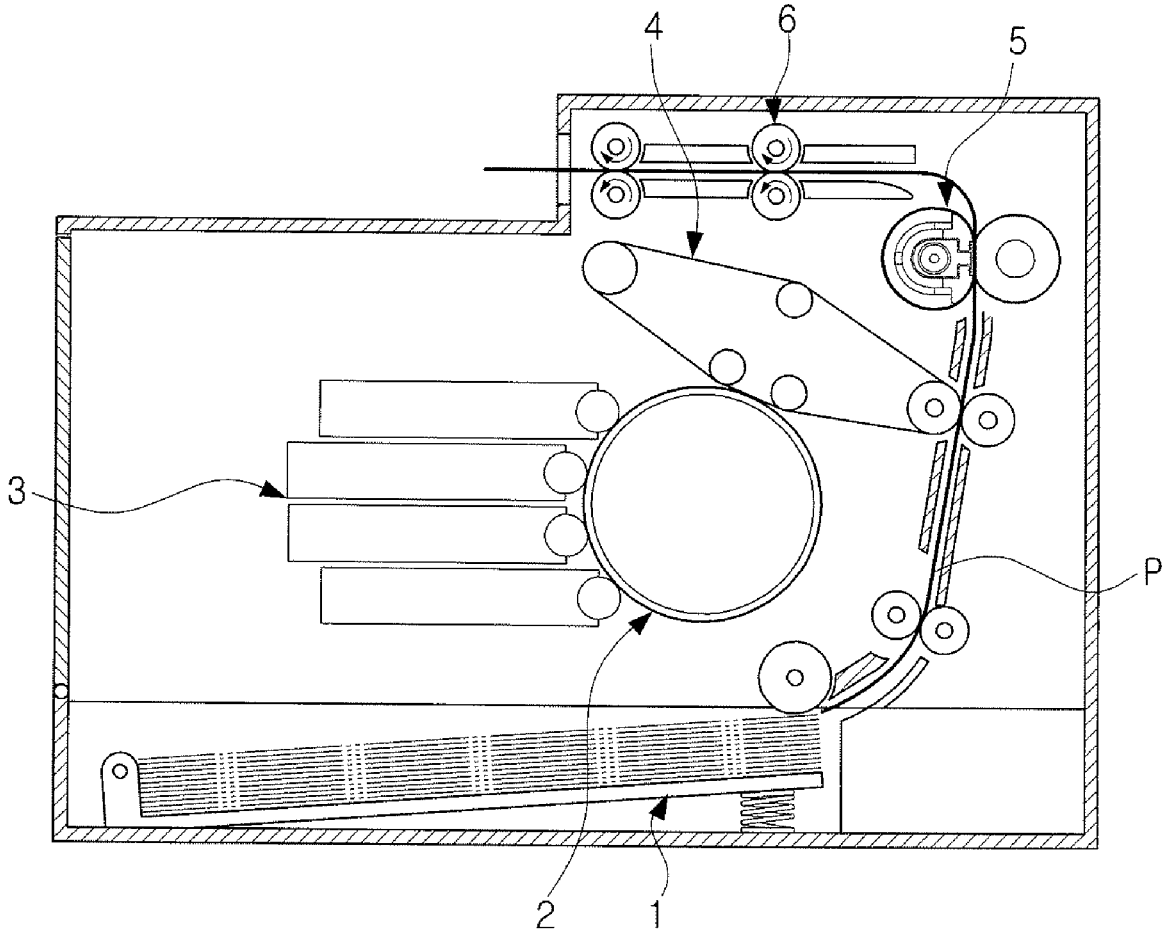
FIG. 13 is a schematic cross-section view illustrating an image forming apparatus having the fusing device according to the exemplary embodiment of the present general inventive concept.

FIG. 13 is a view illustrating an image forming apparatus employing the fusing device according to one of exemplary embodiments of the present general inventive concept as described above. As illustrated in FIG. 13, an image forming apparatus according to an exemplary embodiment of the present general inventive concept includes a paper feeding device 1, a photoconductive medium 2 where a predetermined electrostatic latent image is formed, a developing device 3 to develop the electrostatic latent image of the photoconductive medium 2 with a developer, a transfer device 4 to transfer a developer image developed by the developing device 3 from the photoconductive medium 2 to a recording medium P, a fusing device 5 to fuse the developer image onto the recording medium P, and a paper discharge device 6.

Structures and effects of the paper feeding device 1, the photoconductive medium 2, the developing device, the transfer device 4, and the paper discharge device 6 are known to an ordinary skilled person in the related art, and thus, their detailed descriptions will be omitted. The fusing device 5 has the features described above with reference to FIGS. 3 to 12. Accordingly, the image forming apparatus according to an exemplary embodiment of the present general inventive concept can provide a satisfactory product meeting a recent demand for a high speed operation corresponding to a user's preference.

In the fusing device and the image forming apparatus according to the exemplary embodiments of the present general inventive concept, the belt unit 200 except for the nip is heated directly with the radiant heat from the heating unit 400, whereas the nip is heated with the heat collected at the nip forming unit 300. Accordingly, the heating unit 400 has a low heat capacitance but effectively uses the heat radiated therefrom, and thus, a high speed heating and a thermal stability can be guaranteed and also a high speed printing operation can be achieved.

Also, according to the exemplary embodiments of the present general inventive concept, the support unit 500 uniformly supports the nip portion 320 of the nip forming unit 300 along an axial direction and simultaneously presses the nip portion 320 against the pressure unit 100, thereby guaranteeing a stable nip width and enhancing fusing performance.

Also, according to the exemplary embodiments of the present general inventive concept, the heat insulating member 600 to insulate heat transmitted from the nip forming unit 300 to the support unit 500 is provided so that a heating temperature of the belt unit 200 at the nip portion 320 can be increased.

Also, according to the exemplary embodiments of the present general inventive concept, the reinforcing member 530 of the support unit 500 constantly presses the nip forming unit 300 and also the plurality of parallelogrammic-shaped heat transmission portions 530*a* formed on the reinforcing member 530 allow radiant heat from the heating unit 400 to be uniformly transmitted to the belt unit 200 such that a temperature deviation does not occur in the belt unit 200 in the breadthwise direction of the recording medium P and thus fusing performance can be improved. That is, since the time required for the belt unit 200 to be heated by the heating unit 400 during the rotation is regular in the breadthwise direction of the belt unit 200, the temperature deviation of the belt unit 200 is decreased and accordingly uniform fusing operation can be performed.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A fusing device, comprising:

a pressure unit;

a belt unit to rotate in outer contact with the pressure unit;

a nip forming unit to form a nip over a contact portion between the pressure unit and the belt unit;

a heating unit to heat the nip forming unit and the belt unit; and a support unit to press and support the nip forming unit constantly and having a plurality of heat transmission portions defined in a parallelogrammic shape of an oblique direction with respect to a traveling direction of the belt unit.

2. The fusing device as claimed in claim 1, wherein the pressure unit comprises a rotary roller member, and the belt unit comprises a belt member rotated by a rotational force received from the roller member.

3. The fusing device as claimed in claim 1, wherein the support unit comprises:

opposite support members corresponding to opposite ends of the nip forming unit; and a reinforcing member to connect the opposite support members, wherein the reinforcing member includes a plurality of oblique line type reinforcing ribs arranged at regular intervals along a lengthwise direction of the reinforcing member in order to define the plurality of heat transmission portions.

4. The fusing device as claimed in claim 3, wherein the reinforcing member is in an arch shape and the opposite support members and the reinforcing member are integrally formed with each other.

5. The fusing device as claimed in claim 3, wherein the support unit satisfies the following equation:

$$\tan\theta=(w+t)/h$$

wherein 'w' denotes a width of the heat transmission portion, 'h' denotes a height of the heat transmission portion, 't' denotes a thickness of the reinforcing rib, and 'θ' denotes an angle formed by the reinforcing rib with respect to a traveling direction of the belt unit.

6. The fusing device as claimed in claim 1, wherein the heat transmission portions of the support unit are arranged along two or more lines.

7. The fusing device as claimed in claim 1, wherein the nip forming unit comprises:

a body portion to collect radiant heat from the heating unit; and a nip portion connected with the body portion and contacting the belt unit.

8. The fusing device as claimed in claim 7, wherein a portion of the body portion corresponding to the heat transmission portions of the support unit is opened.

9. The fusing device as claimed in claim 7, wherein the body portion comprises an arch type reinforcing portion to reinforce a strength of the nip forming unit, and the reinforcing portion comprises a plurality of second heat transmission portions corresponding to the heat transmission portions of the support unit.

10. The fusing device as claimed in claim 9, wherein the second heat transmission portions are arranged along two or more lines.

11. The fusing device as claimed in claim 1, further comprising:

a heat insulating member disposed between the nip portion of the nip forming unit and the opposite support members of the support unit to prevent heat of the nip forming unit from being transmitted to the support unit.

12. The fusing device as claimed in claim 11, wherein the heat insulating member has a curved surface contacting the belt unit.

13. A fusing device, comprising:

a rotatable pressure roller;

a fusing belt to rotate with a rotational force received from the pressure roller;

a nip forming member having a nip portion which is inner contact with the fusing belt to form a nip over a contact portion between the pressure roller and the fusing belt;

a heating member disposed substantially at a center of the fusing belt to heat the nip forming member and the fusing belt;

opposite support members disposed inside the fusing belt to press and support opposite sides of the nip portion of the nip forming member toward the pressure roller; and a reinforcing member in an arch shape to connect the opposite support members to reinforce a strength of the opposite support members and having a plurality of heat transmission portions defined in a parallelogrammic shape of an oblique direction with respect to a forward direction of the belt unit in order to uniformly transmit radiant heat from the heating member to the fusing belt.

14. The fusing device as claimed in claim 13, wherein the reinforcing member comprises:

a plurality of oblique line type reinforcing ribs arranged at regular intervals along a lengthwise direction of the reinforcing member in order to define the plurality of heat transmission portions.

15. The fusing device as claimed in claim 14, wherein the support member satisfies the following equation:

$$\tan\theta=(w+t)/h$$

wherein 'w' denotes a width of the heat transmission portion, 'h' denotes a height of the heat transmission portion, 't' denotes a thickness of the reinforcing rib, and 'θ' denotes an angle formed by the reinforcing rib with respect to a traveling direction of the fusing belt.

16. The fusing device as claimed in claim 15, wherein the nip forming member comprises a body portion to collect radiant heat from the heating member to transmit the radiant heat to the nip portion, the body portion comprises an arch type reinforcing portion to reinforce a strength, and the reinforcing portion comprises second heat transmission portions corresponding to the plurality of heat transmission portions.

17. The fusing device as claimed in claim 16, wherein the opposite support members are integrally formed with the reinforcing member.

18. The fusing device as claimed in claim 17, wherein the nip portion, the body portion, and the reinforcing portion of the nip forming member are integrally formed with one another.

19. The fusing device as claimed in claim 13, further comprising:

a heat insulating member disposed between the opposite support members and the nip portion of the nip forming member to prevent heat of the nip portion from being transmitted to the opposite support members, wherein the heat insulating member has a curved surface contacting the fusing belt.

20. An image forming apparatus, comprising:

a photoconductive medium where an electrostatic latent image is formed;

a developing device to develop the electrostatic latent image of the photoconductive medium with a developer;

a transfer device to transfer a developer image from the photoconductive medium to a recording medium; and a fusing device to fuse the developer image onto the recording medium, the fusing device comprising:

a pressure unit;

a belt unit to rotate in outer contact with the pressure unit;

a nip forming unit to form a nip over a contact portion between the pressure unit and the belt unit;

a heating unit to heat the nip forming unit and the belt unit; and a support unit to press and support the nip forming unit constantly and having a plurality of heat transmission portions defined in a parallelogrammic shape of an oblique direction with respect to a traveling direction of the belt unit.

* * * * *